US006895197B2

(12) United States Patent
Shibata

(10) Patent No.: US 6,895,197 B2
(45) Date of Patent: May 17, 2005

(54) METHOD AND APPARATUS FOR FORMING AN IMAGE

(75) Inventor: Kyoichi Shibata, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/300,785

(22) Filed: Nov. 21, 2002

(65) Prior Publication Data

US 2004/0165906 A1 Aug. 26, 2004

(51) Int. Cl.[7] ..... G03G 15/00
(52) U.S. Cl. ..... 399/82; 399/401
(58) Field of Search ..... 399/82, 85, 397, 399/401

(56) References Cited

U.S. PATENT DOCUMENTS 4,918,490 A * 4/1990 Stemmle ..... 399/401
5,095,342 A * 3/1992 Farrell et al. ..... 399/401
5,159,395 A * 10/1992 Farrell et al. ..... 399/401
5,337,135 A * 8/1994 Malachowski et al. ..... 399/401
5,680,651 A * 10/1997 Tsuji et al. ..... 399/401
5,852,764 A * 12/1998 Kida et al. ..... 399/401
5,883,660 A 3/1999 Kato et al.

* cited by examiner

*Primary Examiner*—Sandra L. Brase
(74) *Attorney, Agent, or Firm*—Foley & Lardner LLP

(57) ABSTRACT

According to the present invention, there is provided an image forming apparatus, in which it is possible to shorten a first output time and restrain a medium from being curled caused by a prolonged time required for reversing the medium. The image forming apparatus has a reversing unit for reversing the obverse and reverse of the medium, thereby reducing a time during which the medium stays inside the reversing unit to a predetermined time or shorter.

11 Claims, 9 Drawing Sheets

METHOD AND APPARATUS FOR FORMING AN IMAGE

BACKGROUND OF THE INVENTION

The present invention relates to an apparatus for forming an image on an output medium.

In the case where images are output on double sides of an output medium, for example, plain paper, a one-sheet circulating system is simplest in which images are output in the order of a second page, a first page, a fourth page, a third page, . . . , while feeding the media one by one. However, the throughput, i.e., the number of sheets output per unit time is not increased since time is required for reversing the obverse and reverse of the medium, i.e., turning it over.

Therefore, an alternate circulation system is currently adopted in which an image is output on the subsequent medium when the previous medium is reversed, thereby increasing the throughput.

In the alternate circulation system, images are output to the media, respectively, in the order of a second page, a fourth page, a first page, a sixth page, a third page, an eighth page, . . . . In the alternate circulation system, generally, a medium on which an image is next output is transported to a predetermined position inside a reversing unit for reversing the obverse and reverse of the medium. The medium transported inside of the reversing unit stays inside of the reversing unit until the edition of image data to be output next is finished.

When the generation of image data for each page by an image forming apparatus is slower than the image forming speed of the image forming apparatus, an interval at which the image is output to the medium, i.e., an interval at which the image output is obtained, becomes greater than an interval at which the media can be sequentially supplied (that is to say, the throughput is decreased).

Examples of factors that cause the generation of image data to be slower than the image forming speed include:

i) much time is required for compiling, caused by complicated image data and the substantially large amount of image data;

ii) time is prolonged until the image data is transferred to the image forming apparatus, due to heavy traffic on network;

iii) an image reading speed by a scanner is slower than the image forming speed of the image forming apparatus; and iv) a transferring speed is slower than the image forming speed of the image forming apparatus in the case where the image data is supplied via a facsimile network.

Due to these factors, the medium transported inside the reversing unit often stays inside the reversing unit for a long period of time, in comparison with the case where the media are sequentially transported.

Since a transporting path, that is, a medium transporting path inside the reversing unit includes curves in many cases, there arises a problem that the medium is curled if the medium being transported stays inside the reversing unit for a time longer than a predetermined period of time. Factors leading to the medium being curled are, particularly, small radius curves and/or the influence of heat applied to the medium in fixing.

If the medium is curled, the medium is liable to jam inside the reversing unit or along the transporting path. Furthermore, even if the medium can be free from jamming, a skew may occur on the medium transported on the transporting path or through the reversing unit, thereby raising a problem that the image output to the medium is skewed.

Here, even when the medium stays inside the reversing unit for a time longer than the predetermined time, the medium can be prevented from being curled. For example, if a region in which the medium inside of the reversing unit stays, that is, the transporting path is straight, the medium can be avoided from being curled even when the medium stays inside of the reversing unit for the time longer than the predetermined time. However, if a straight section is provided, this inevitably increases the size of the reversing unit, which increases the overall size of the apparatus, leading to increased costs.

Further, if image formation is started after storage of all the image data, it is possible to prevent the medium from remaining in the reversing unit for longer than necessary. However, providing a storage unit also increases the cost, and delays output of the first printed sheet.

BRIEF SUMMARY OF THE INVENTION

An object of the present invention is to provide an image forming apparatus, in which a first output time can be shortened, and further, a medium can be prevented from being curled, which is caused by a longer time required for reversing the medium.

According to an aspect of the present invention, there is provided an image forming apparatus comprising:

a reversing unit which reverses the obverse and reverse of a medium, on either side of which an image output is output, so as to transport the medium in such a manner that an output image can be output on the other side thereof;

an image forming unit which outputs an image output corresponding to image data on a predetermined side of the medium;

a data generating unit which generates image data that can be output by the image forming unit, in response to an image signal;

an image data holding unit which holds the image data generated by the data generating unit;

an image data transfer, control unit which, in the case where the image data of two pages is held in the image data holding unit, outputs image data corresponding to 2n-th, 4n-th, . . . , mn-th pages on either side of each of first and second media, and subsequently outputs an image output corresponding to image data of a 2n−1-th page on the other side of the medium, on which the image output corresponding to the image data of the 2n-th page is output and outputs an image output corresponding to image data of a 4n−1-th page on the other side of the medium, on which the image output corresponding to the image data of the 4n-th page is output after the obverses and reverses of the respective media are reversed by the reversing unit; and a medium transportation control unit which, in the case where the image data of two pages is held in the image data holding unit, feeds the first and second media in a predetermined order in such a manner as to output the image outputs corresponding to the 2n-th, 4n-th, . . . , mn-th pages on either side of each of the first and second media, and thereafter reverses the obverses and reverses of the respective media by the reversing unit, feeds the first medium in such a manner as to output the image output of the 2n−1-th on the other side of the first medium, on which the image output of the 2n-th page is output, feeds the second medium in such a manner as to output the image output of the 4n−1-th on the other side of the second medium, on which the image output of the 4n-th page is output, and transports the medium, on which the image output corresponding to any page of the 2n-th, 4n-th, . . . , mn-th pages is being output, to the reversing unit so as to reverse the obverse and reverse of the medium in such a manner as to output the image output preceded by one page to the page of the image output that has been just output on the other side of the medium at the time when it is detected that the image data of two pages are not held in the image data holding unit.

According to another aspect of the present invention, there is provided an image forming apparatus comprising:

an image memory which stores image data therein;

an image forming unit which outputs an image output on a predetermined side of a medium;

a reversing unit which reverses the obverse and reverse of the medium, on a first side of which the image output has been already output;

a medium transportation control unit which supplies the medium that has been transported to the reversing unit to the image forming unit again in order to output an image output on a second side, that is the reverse of the first side of the medium being transported to the reversing unit; and an image data control unit which, in the case where the image data of two pages are not stored in the image memory during the reversing of the medium, outputs image outputs in a first image forming mode of outputting an image output corresponding to image data of an even page on the first side of the medium, reversing the obverse and reverse, and outputting an image output corresponding to image data of an odd page on the reverse of the first side, and further outputs image outputs in a second image forming mode of, at the time when the image data stored in the image memory reach the amount of two pages, sequentially outputting an image output corresponding to image data of an n-th page that is an even page, and an image output corresponding to image data of a 2n-th page on first and second sides of-each of sequential two media, respectively, reversing the obverses and reverses of the respective media, and thereafter outputting an image output corresponding to image data of an n−1-th page on the reverse of the first side of the medium, on which the image output corresponding to the image data of the n-th page is output, and subsequently outputting an image output corresponding to image data of a 2n−1-th page on the reverse of the first side of the medium, on which the image output corresponding to the image data of the 2n-th page is output.

According to still another aspect of the present invention, there is provided an image forming method comprising:

feeding first and second media in a predetermined order in such a manner as to output image outputs corresponding to 2n-th, 4n-th, . . . , mn-th pages on one side of each of the first and second media in the case where image data of two pages is held in an image data holding unit;

reversing the obverses and reverses of the respective media by a reversing unit;

feeding the first medium in such a manner as to output an image output of a 2n−1-th page on the other side of the first medium, on which the image output of the 2n-th page is output, and feeding the second medium in such a manner as to output an image output of a 4n−1-th page on the other side of the second medium, on which the image output of the 4n-th page is output;

transporting the medium, on which the image output corresponding to any page of the 2n-th, 4n-th, . . . , mn-th pages is being output, to the reversing unit so as to reverse the obverse and reverse of the medium at the time when it is detected that image data of two pages is not held in an image data holding unit; and transporting the medium in such a manner as to output an image output of a page preceded by one page to the page of the image output that has been just output on the other side of the medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One example of the operation of an image forming apparatus to which an embodiment according to the present invention is applied is described below, with reference to the accompanying drawings.

Figure 1:
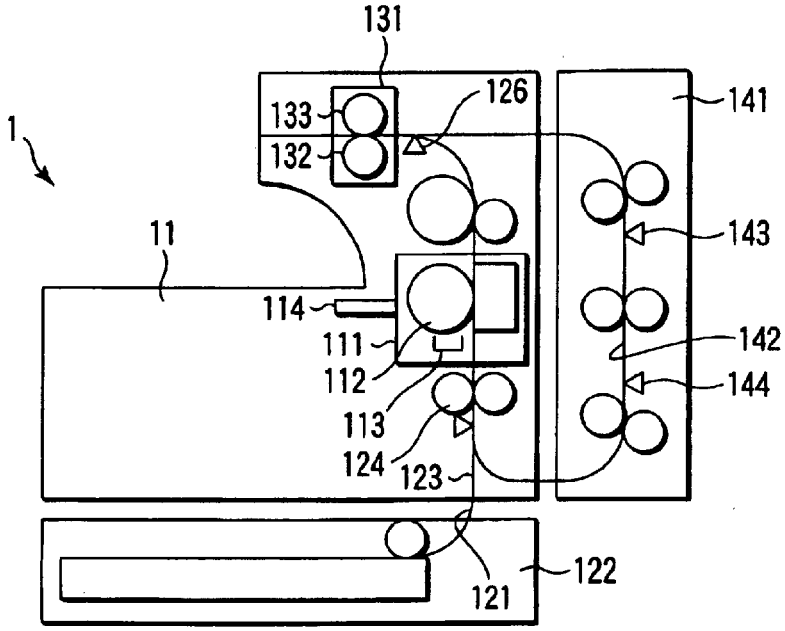
FIG. 1 is a schematic diagram illustrating one example of an image forming apparatus, to which an embodiment according to the present invention can be applied.

FIG. 1 illustrates one example of an image forming apparatus and, more particularly, it is a schematic diagram illustrating a printer apparatus having a both-sides unit capable of outputting images on double sides of a sheet of paper, by reversing it.

As illustrated in FIG. 1, the printer apparatus 1 includes many mechanical sections; a process unit 111, a medium (paper) transporting system 121, a fixing unit 131 and a double-sided unit 141.

The process unit 111 forms an output image as a visible image corresponding to image data supplied from a data supplying unit represented by, for example, a host computer, etc. Incidentally, the process unit 111 includes a photosensitive drum 112 capable of forming an image by, for example, an electrophotographic system, that is, holding a latent image corresponding to the image data and a developing device 113 for supplying a toner to the latent image held by the photosensitive drum 112 so as to make the image visible. Furthermore, the process unit 111 may be any of various image forming systems usable in a known printer apparatus, such as a thermal transfer system or an ink jet system. In the present embodiment, for example, a laser beam exposing device 114 for continuously irradiating the photosensitive drum 112 in a longitudinal direction with a laser beam is used as an exposing device.

The paper transporting system 121 includes a paper cassette 122 for holding the media for holding output images thereon, that is, an arbitrary number of sheets of paper, a transporting path 123 for guiding a paper sheet P transported between the paper cassette 122 and the process unit 111 and between the process unit 111 and the fixing unit 131, aligning rollers 124 for eliminating a skew of the paper sheet P transported on the transporting path 123 etc. Here, the path 123 includes a plurality of sensors such as an aligning sensor 125 and a fixture/both-sides sensor 126 for detecting paper jam, i.e., jamming of the paper sheet P transported on the path 123 at an arbitrary position on the path 123.

The fixing unit 131 includes a first roller 132 for raising the temperature up to a predetermined value, and a second roller 133 for applying a given pressure to the first roller 132. The fixing unit 131 fuses and pressurizes the toner electrostatically adhered to the paper when the paper passes between the rollers, and thus fixes the toner onto the paper. Usually, the fixing unit 131 is disposed integrally with the first roller 132, and includes a heater (not shown) for raising the temperature of the first roller 132 up to a predetermined value.

The double-sided unit 141 includes a path 142 configured similarly to the transporting system 121, a plurality of rollers or belts or their combination, although they are not described in detail, and a plurality of sensors capable of detecting a paper jam, i.e., the jamming of the paper sheet P transported on the path 142 at an arbitrary position of the path 142. Examples of the sensors include an entry sensor 143 for detecting that the paper is transported on the path 142, and a discharge sensor 144 for detecting that the paper can be discharged toward the transporting system 121.

In the above-described printer apparatus 1, the output image which is made visible by the process unit 111 is transferred onto a first side of the paper sheet P supplied from the cassette 122 at a predetermined timing by electrostatic force applied from a transferring device 115, which is not described in detail. Incidentally, the position of the output image developed on the photosensitive drum 112 is aligned, by the aligning rollers 124, with the end of the paper sheet P before the output image is transferred onto the paper sheet P. The paper sheet P having the output image transferred thereonto is transported along the path 123 inside the transporting system 121, and then, is guided to the fixing unit 131.

The toner fused by the heat applied by the first roller 132 is fixed to the paper sheet P, to which the toner image guided between the first roller 132 and the second roller 133 in the fixing unit 131 through the transporting system 121 electrostatically adheres, with the application of pressure by the second roller 133.

The paper sheet P having the toner image, i.e., the output image fixed thereto is guided to the double-sided unit 141 by reversing the rotating direction of at least one of the first and second rollers 132 and 133 in the fixing unit 131 at the time of outputting on double sides, described in detail later.

The obverse and reverse of the paper sheet P having the output image fixed onto the first side thereof and guided to the double-sided unit 141, are reversed in such a manner that the second side thereof can be brought into contact with the photosensitive drum 112 in the process unit 111, so that the front and rear end are reversed, and thus the paper is guided to the aligning rollers 124 in the transporting system 121.

Figure 2:
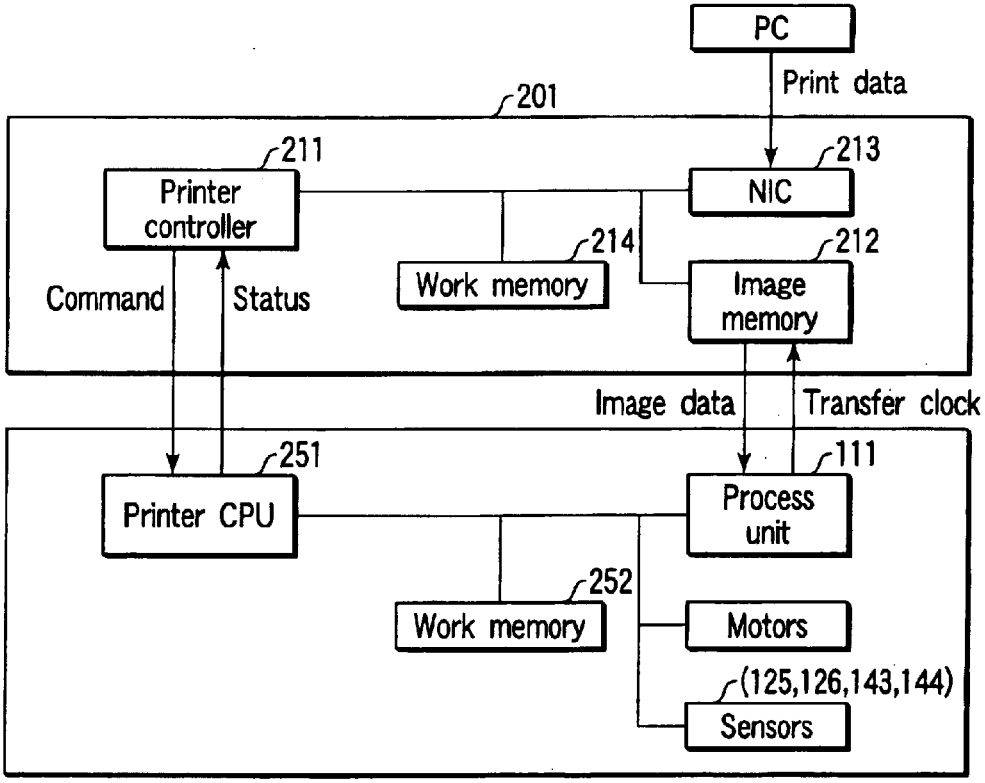
FIG. 2 is a schematic block diagram illustrating one example of a flow of image data in the image forming apparatus illustrated in FIG. 1.

FIG. 2 is a schematic diagram illustrating one example of a control system usable in the printer apparatus illustrated in FIG. 1.

As illustrated in FIG. 2, the printer apparatus 1 includes a printer controller 201 for controlling the fetch of the image data used for outputting the output image by the process unit 111 and the output of the image data.

The printer controller 201 is provided with a data control CPU 211 and a process CPU 251 for controlling the operation of the process unit 111.

To the data control CPU 211 are connected an image memory 212 for storing therein, per page, the image data corresponding to the output image to be output from the process unit 111, a network interface 213 capable of inputting the image data into the image memory 212 from an external device represented by a personal computer (abbreviated as "a PC") and the like. Here, the network interface 213 also is referred to as a network interface card (abbreviated as "an NIC") since it is often formed into the shape of a card.

To the data control CPU 211 is further connected a page order managing device (i.e., a work memory) 214 capable of changing the output order of the image data stored in the image memory 212 to the process unit 111.

To the process unit CPU 251 is connected a work memory 252 for storing the image data of one page stored in the image memory 212 as, for example, parallel data such that the process unit 111 actually outputs the image output. To the process CPU 251 are further connected various elements (not shown) defining the process unit 111, and drivers required for actuating the elements.

In addition, to the process unit CPU 251 are connected through a motor drivers (not shown), a plurality of motors, such as a feed motor for drawing the paper from the paper cassette 122, a transporting system motor for rotating the rollers disposed in the paper transporting system 121, a main motor for rotating the photosensitive drum 112 at a predetermined speed, a fixing motor for rotating the roller 132 in the fixing unit 131, a both-sides transporting motor for rotating an arbitrary roller or belt on the path 142 in the double-sided unit 141.

To the process unit CPU 251 are further connected paper sheet passage sensors, that is, the aligning sensors 125, the fixture/both-sides sensor 126, the entry sensor 143 and the discharge sensor 144, which are disposed at predetermined positions in the transporting system 121 and the double-sided unit 141, and a plurality of sensors, such as temperature sensors for detecting the ambient temperature a-round the photosensitive drum 112 and the temperature of the fixing roller 132 in the fixing unit via input circuits (not shown). Here, since some of the sensors output a detection output (i.e., a current value) after voltage conversion, the input circuit is not always required.

Next, a detailed description will be given of one example of the operation of the printer apparatus illustrated in FIGS.

1 and 2. Here, the operation described below is exemplified by the both-sides output of a plurality of sheets, for example, five sheets (i.e., ten pages), in which the output images are formed on double sides of each of the sheets.

Print-out data corresponding to an image to be printed out is supplied from the external device, for example, the personal computer PC to the printer apparatus 1 via the network interface 213 in ascending page number order.

The print-out data input into the network interface 213 is edited based on a predetermined rule or restriction by the data control CPU 211, and then, is stored in the image memory 212 as the image data.

The image memory 212 stores the image data of an arbitrary number of pages. Although the order of the image data stored in the image memory 212 is managed by image processing software (i.e., application), the order is determined by the order of reception of the image data from the external device (i.e., the above-described ascending page number) unless notified otherwise.

When the image data of the obverse and reverse, i.e., two pages are stored in the image memory 212, the data control CPU 211 instructs the start of the formation of the output images, that is, outputs a printing command to the process unit CPU 251.

The process unit CPU 251 receives the printing command from the data control CPU 211, and then, rotates a paper feeding motor for rotating a paper feeding roller for a predetermined period of time, although not described in detail. Consequently, a piece of paper sheet P is drawn from the cassette 122, and transported along path 123.

Incidentally, the process unit CPU 251 is notified that the paper reaches a predetermined position on the path 123 when the paper reaches a paper sensor, not described in detail, disposed at a predetermined position on the path 123, or the aligning sensor 125, usually positioned immediately before the aligning rollers 124.

Subsequently, an image data transfer (starting) clock which requests start of the transfer of the image data is output to the data control CPU 211 from the process unit CPU 251 at a predetermined timing.

The data control CPU 211 receives the image data transfer starting clock, and then, outputs the edited image data stored in the image memory 212 to the exposing device 114 at a given timing. Consequently, an unillustrated electrostatic image (i.e., a latent image) is formed on the photosensitive drum 112. The latent image formed on the photosensitive drum 112 is made visible using the toner from the developing device 113.

In the printer apparatus 1 illustrated in reference to FIGS. 1 and 2, the output image of an even page is formed on the reverse of the paper (i.e., the medium) fed from the cassette 122 in the case where the output images are formed on double sides of the paper, and then, the side of the paper is reversed to the obverse by the double-sided unit 141. Thereafter, the output image of a page (i.e., an odd page) preceded by one page to the even page, the output image of which has been already output, is formed on the other side.

The piece of paper sheet P having the output images formed on double sides thereof is discharged to a paper discharge tray 11, also serving as a part of the external case of the printer apparatus 1, in such a manner that the side having the output image of the even page formed thereon can be seen (in other words, in such a manner that the side having the output image of the odd page formed thereon faces the tray 11) (face-down discharge).

Therefore, the order of the image data required for forming the output images is normally a page 2, a page 1, a page 4, a page 3, a page 6, a page 5, . . . , as described later in reference to FIG. 3B. Incidentally, a system in which the output images are formed in the above-described order is referred to as a one-sheet circulating system.

On the contrary, the arrangement (i.e., the storing order) of the print-out data in the image memory 212 is the ascending order from the small page number, as described already. Hence, the operation of compiling/expanding the print-out data of the first page has been completed at the time the operation of compiling/expanding the print-out data stored in the image memory 212 into the image data is completed up to the image data of the second page to be first output as the output image.

In the above-described method, there has been widely adopted these days a so-called alternate circulation system.

In the alternate circulation system, the output image of the first even page (i.e., a page 2) is formed on the reverse of the paper (i.e., the medium) fed from the cassette 122, and then, the piece of paper is turned over by the double-sided unit 141 (described later in reference to FIG. 3A). During this time or at a predetermined timing, a second piece of paper is fed from the cassette 122, and then, the output image of the next even page (i.e., page 4) is formed on the reverse of the second piece of paper. Next, the first paper having the output image of page 2 formed thereon is fed from the double-sided unit 141, and then, an output image of the preceding odd page (i.e., page 1) is formed thereon, on page 1. The first piece of paper having the output images (of pages 1 and 2) formed on double sides thereof is discharged to the discharge tray 11. During this time or at a predetermined timing sequential to the first paper, a third piece of paper is fed from the cassette 122, and then, an output image of a sequential even page (i.e., page 6) is formed on the reverse.

The third piece paper having the output image of page 6 formed on the reverse thereof is guided to the double-sided unit 141 in the same manner as the second piece of paper having the output image of the page 4 already formed thereon.

Subsequently, the piece of paper having the output image of page 4 already formed thereon is fed from the double-sided unit 141, and then, an output image of a preceding odd page (i.e., page 3) is formed on the other side of this piece of paper. Here, the (second) piece of paper having the output images of pages 3 and 4 formed thereon is discharged to the discharge tray 11 in such a manner that the third page faces the second page of the first paper already discharged. In other words, the second piece of paper is discharged to the discharge tray 11 in ascending page order.

Hereinafter, sheets of paper are alternately transported toward the process unit 111 from the cassette 122 and the double-sided unit 141. That is to say, the output image of the even page and the output image of the odd page preceded by three pages to the output image of the output even page are alternately formed in the process unit 111.

Incidentally, after an output image corresponding to image data of a final even page is formed, two sheets of paper having the output images of the even pages already formed thereon are naturally contained in the double-sided unit 141. The remaining image data, no output image is formed, stored in the image memory 213 are image data preceded by three pages to the final even page and image data preceded by two pages to the final even page, that is, image data of two odd pages.

Therefore, after the piece of paper having the output image corresponding to the final even page formed thereon is fed from the paper cassette 122, no more sheets of paper are supplied from the paper cassette 122, and further, an output image corresponding to image data preceded by three pages to the final even page is formed on the preceded paper contained in the double-sided unit 141. Subsequently, an output image corresponding to image data preceded by one page to the final even page is formed on the remaining pieces of paper contained in the double-sided unit 141. Here, also in the case where there is no image data corresponding to the final even page, that is, also in the case where the total number of pages of all of the output images is odd, it is understood that the process of transporting the sheets of paper should be the same as described above.

Next, explanation will be made on one example of a circulation system in the embodiment according to the present invention, in which no pieces of paper remain inside the double-sided unit 141 in the case where a timing at which the image data is transferred to the image memory 212 by the data control CPU 211 is delayed in the alternate circulation system, wherein alternate circulation and one-sheet circulation can be combined.

When the image data to be transferred to the image memory 212 is transferred with a delay longer than a predetermined time, due to some reason, in the above-described alternate circulation system, the paper is curled caused having the output image already formed on either side thereof inside of the double-sided unit 141. Therefore, at the time when it is detected that a sheet of paper is present inside the double-sided unit 141, the alternate circulation system is switched to the one-sheet circulating system, thereby preventing the piece of paper from remaining inside the double-sided unit 141.

Figures 3A, 3B:
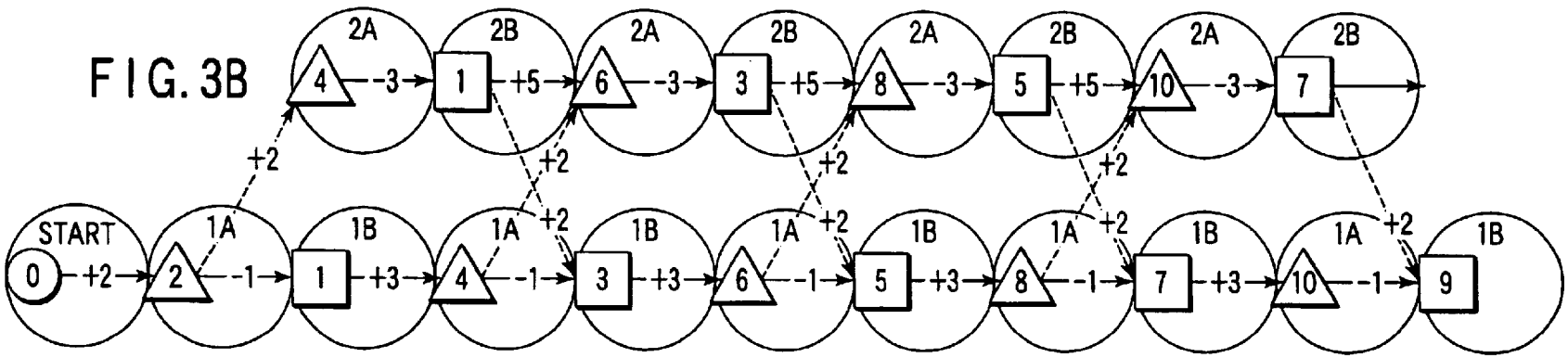
FIGS. 3A and 3B are schematic diagrams illustrating the relationship between a medium transporting order by the image forming apparatus illustrated in FIGS. 1 and 2 and the page order of the image data.

FIGS. 3A and 3B are schematic diagrams illustrating the relationship between a paper transporting order in the alternate circulation system and the one-sheet circulating system and the page order of the image data of the output image on the obverse and reverse of the paper. Here, FIG. 3A is a diagram illustrating an example of the alternate circulation; and FIG. 3B is a diagram illustrating an example of the one-sheet circulation. A plurality of arrows connecting FIGS. 3A and 3B to each other indicate the switches of the image data and the paper transporting order from the alternate circulation to the one-sheet circulation or from the one-sheet circulation to the alternate circulation.

Referring to FIGS. 3A and 3B, the obverse and reverse of the paper and the page order of the image data are classified into a pattern A, in which the image data corresponding to the even page is output, and then, the output image is transferred, wherein the page number is enclosed by a square, and a pattern B, in which the image data corresponding to the odd page is output, and then, the output image is transferred, wherein the page number is enclosed by a triangle. Incidentally, in addition to the above-described patterns A and B, there is a pattern at the time of the start, which is referred to as a pattern "S" for the sake of convenience, wherein the page number is "0" and is enclosed by a circle. In order to distinguish the alternate circulation and the one-sheet circulation from each other, "2" is given on each of the patterns in the alternate circulation illustrated in FIG. 3A while "1" is given on each of the patterns in the one-sheet circulation illustrated in FIG. 3B. Consequently, it is sufficient that only five patterns in total are considered in rearranging the page order of the image data corresponding to each of the transporting systems of the alternate circulation and the one-sheet circulation. In an actual printing operation, a final page is not known or not limited in many cases, although data indicating a final page may be supplied. Therefore, the number of pages of the total image data is managed based not on the total page number, but a relative value.

In the embodiment according to the present invention, the total image data is stored in the image memory 212. Consequently, the rearrangement of the page order of the image data held in the image memory 212 in a manner corresponding to either the alternate circulation system or one-sheet circulating system can be readily achieved by the page order managing device (i.e., the work memory) 214 connected to the data control CPU 211.

For example, when the start of the image formation in the alternate circulation system is instructed, the image data of the second page is transferred to the image memory 212 in the pattern S. Hereinafter, the first piece of paper is drawn from the cassette 122 at a predetermined timing, and then, the piece paper drawn from the cassette is transported along the path 123 toward the aligning rollers 124.

While the paper is transported along the path 123, the latent image (i.e., the electrostatic image) corresponding to the image data of the second page transferred to the image memory 212 is formed on the photosensitive drum 112. In other words, a light beam with a changed light intensity is emitted from the exposing device 114 to the photosensitive drum 112 based on the image data held in the image memory 212.

The toner is selectively supplied to the electro-static image (i.e., the latent image) formed on the photosensitive drum 112 at a developing position at which the developing device. 113 and the photosensitive drum 112 face to each other, thereby making the image visible.

In the meantime, the first piece of paper, which has been transported to the aligning rollers 124, is fed toward a transferring position at which the photosensitive drum 112 and the transferring device 115 are disposed opposite to each other at a predetermined timing in reference to, for example, a timing at which the image data is exposed to the light beam on the photosensitive drum 112 or a timing at which the image data is output from the image memory 212. Consequently, the toner image developed by the developing device 113 is transferred to a predetermined portion of the piece of paper at the transferring position.

The piece of paper, to which the toner image is transferred, is guided on the path 123 toward the fixing unit 131. After the toner image is fixed by the fixing unit 131, the motor (not illustrated) is rotated in a reverse direction, so that the paper is fed along the path 142 of the double-sided unit 141.

Hereinafter, as described already, in the alternate circulation system, a subsequent piece of paper is drawn from the cassette 122, and then, is guided along the path 123. In contrast, in the one-sheet circulating system, the paper transported to the double-sided unit 141 (that is, the paper having the image of the even page already formed thereon) is fed along the path 123.

Here, as described above, the printer controller 201 allows the output data to be stored in the image memory 212 while compiling the output data received from the external device PC, and then, outputs it to the exposing device 114 at a predetermined timing.

If the instruction of the image output, that is, the storing speed of the image data in the image memory 212 becomes slower than the speed of the image formation by the process unit 111 (that is, the image data of two pages cannot be stored in the image memory 212 while the process unit 111 forms the image), the paper unfavorably stays inside the double-sided unit 141 for a predetermined time or longer. In this case, if the alternate circulation is continued, there arises a problem that the paper may be curled or the paper may be skewed after the start of the transportation, as described already.

Therefore, in the embodiment according to the present invention, the process unit CPU 251 requests the data control CPU 211 to switch the output order of the image data in such a manner that the image output by the alternate circulation system is interrupted, and then, the image is output by the one-sheet circulating system at the time when the process unit CPU 111 detects that the image data of two pages are not stored in the image memory 212 while the process unit 111 forms the image.

Upon the request of the switch of the output order of the image data, the process unit CPU 251 allows the paper contained in the double-sided unit 141 to be discharged and/or fed on the path 123, and further, once stops the sequential withdrawal of the sheets of paper from the cassette 122. In this manner, the obverse and reverse of the piece of paper contained in the double-sided unit 141 and having the image of the even page already formed thereon and fixed thereto are reversed, and then, is fed onto the path 123 in such a manner that the side other than the side on which the image has been already formed faces the photosensitive drum 112 at the transferring position.

At the same time or at a predetermined timing, the page order managing device 214 controls to store, in the image memory 212, the image data of the odd page preceded by one page to the even page, the image of which has been already formed.

Consequently, the image of the odd page preceded by one page to the even page having the image already formed thereon is formed on the other side of the paper returned from the double-sided unit 141 onto the path 123 and having the image of the even page already formed thereon.

This is explained by the fact that the one-sheet circulation pattern designated by "1B" can be set after the alternate circulation pattern designated by "2B" out of the five patterns "S", "2A", "2B", "1A" and "1B" illustrated in FIGS. 3A and 3B.

In actuality, with the explanation of the page order of the image data, the image of the second page (i.e., the first even page) is formed on a given side of the first paper in, for example, the alternate circulation ("1A"). Thereafter, the image of the fourth page (i.e., the second even page) is formed on a given side of the second fed paper ("2A").

Subsequently, the image of the first page (i.e., the first odd page) is formed on the side of the first paper other than the side on which the image of the second page has been already formed ("2B"). Note that, this piece of paper is discharged to the discharge tray 11.

Next, the image of the sixth page (i.e., the third even page) is formed on a given side of the third fed paper ("2A"). Subsequently, the image of the third page (i.e., the second odd page) is formed on the side of the second paper, other than the side, on which the image of the fourth page has been already formed ("2B").

Hereinafter, in the two patterns defined by "2A" and "2B", the image formation of the even page preceded by three pages with respect to the relative page number in comparison with the odd page and the image formation of the odd page preceded by three pages are alternately repeated on the reverse of the paper having the image of the even page preceded by three pages already formed thereon.

In contrast, in the arbitrary pattern "2B", as described already, the paper stays on the path 142 in the double-sided unit 141 if the supply of the image data to the image memory 212 is delayed. Therefore, the process CPU 251 sends a print continue request to the printer controller 201 in such a manner that the image is output on the obverse of the paper staying inside the double-sided unit 141. Incidentally, when the print continue request is faster sent from the process CPU 251 to the printer controller 201, there may be a fear that the image is output by the one-sheet circulation, although the image can be output in the alternate circulation. To the contrary, if the timing at which the print continuing request is sent is too late, the throughput may be decreased, as described already.

Figure 4A:
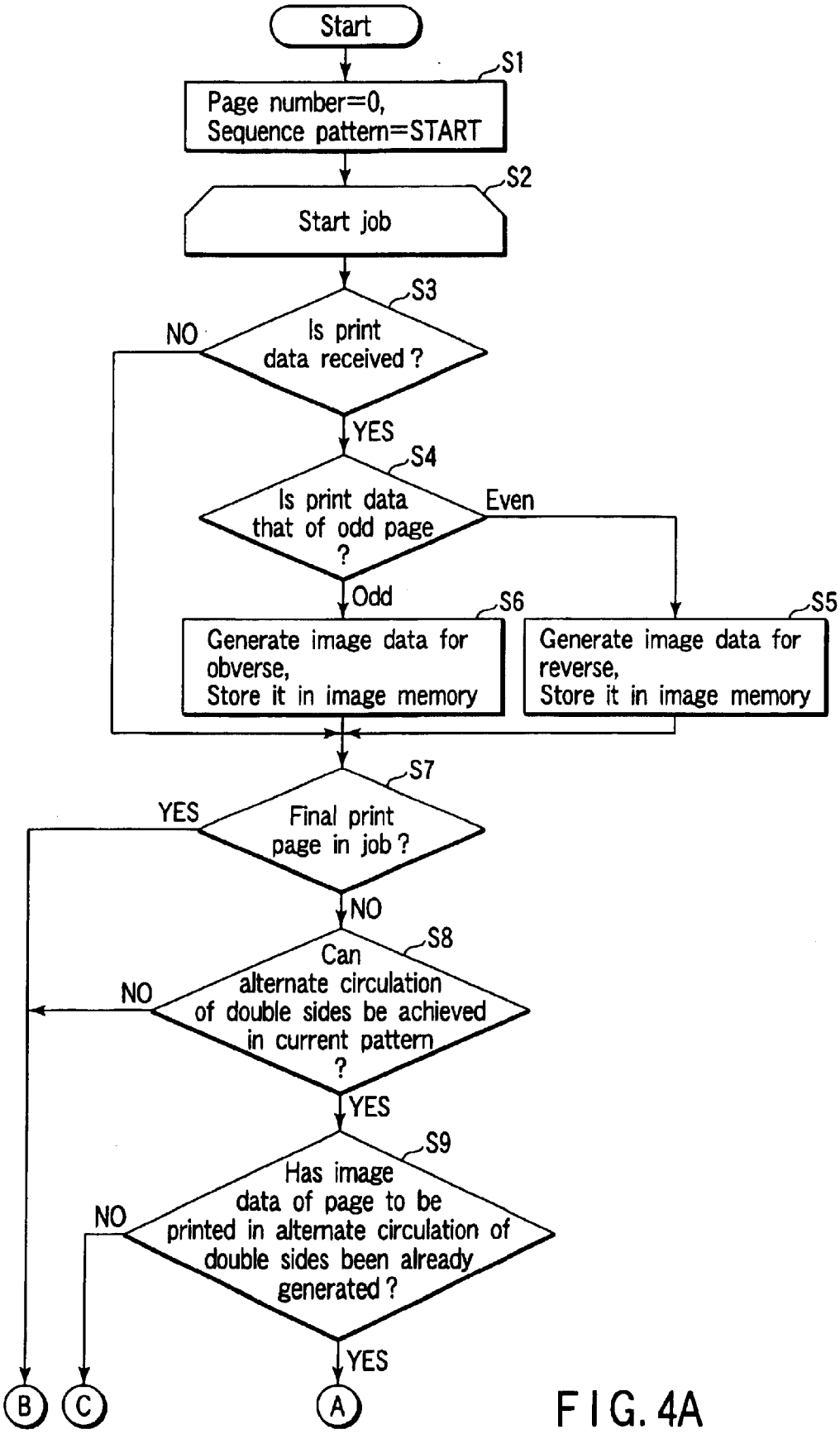
FIGS. 4A and 4B are flowcharts illustrating one example of operation of a printer controller in the image forming apparatus illustrated in FIGS. 1 and 2.
Figure 4B:
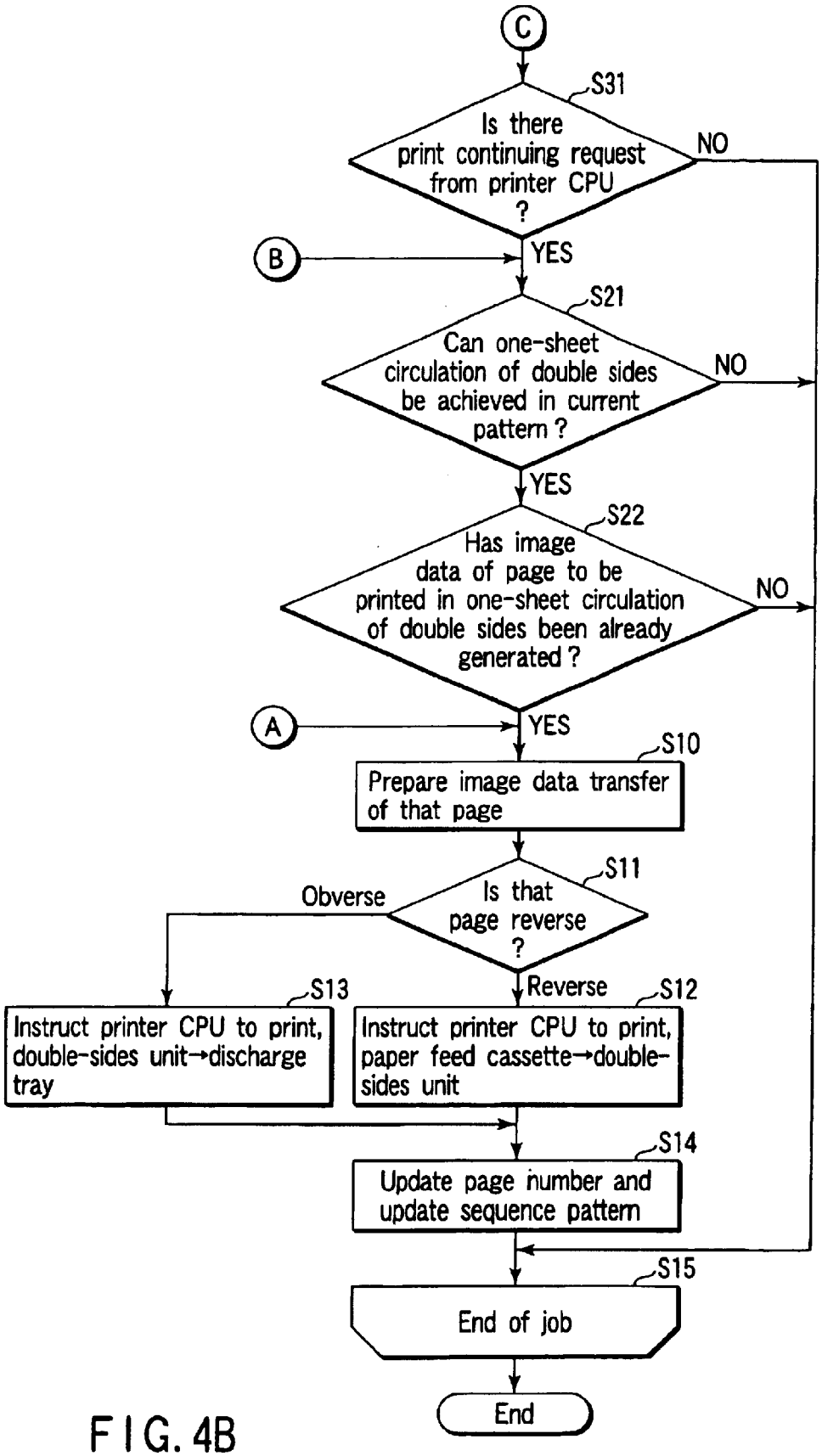

FIGS. 4A and 4B are flowcharts illustrating one example of the operation of the above-described printer controller 201 in detail.

As illustrated in FIGS. 4A and 4B, upon the start of the print process, first, the page number is set to "0", and then, "START" is set as a sequence pattern (S1).

Next, job start is set (S2), and then, it is determined as to whether or not the image data for use in the image output is input (S3).

When it is detected in step S3 that the image data is input (Yes in S3), it is determined as to whether the input image data is image data of an odd page (n−1) or an even page "n".

In step S4, when the input image data is image data of an even page "n", the image data is generated for the reverse, and then, it is stored in the image memory 212 (S5). In contrast, in step S4, when the input image data is image data of an odd page (n−1), the image data is generated for the obverse, and then, it is stored in the image memory 212 (S6).

In the meantime, when the image data is not input during a predetermined period of time in S3 (No in S3), it is determined as to whether or not the already input image data is image data whose final image output in the job is to be output (S7).

If it is detected in step S7 that the already input image data is image data other than the image data whose final image output in the job is to be output (No in S7), it is determined as to whether or not the image output can be output from the already input image data by the alternate circulation (S8).

It is checked in step S8 as to whether or not the image data of pages whose image outputs can be output by the alternate circulation are stored in the image memory 212 (that is, whether or not the image data of two pages have been already generated) (Yes in S8), and further, it is checked as to whether or not the image data of the corresponding two pages have been already generated (S9). In the case where the image data of the two pages have been already generated (Yes in S9), the image data of those pages is prepared to be transmitted (S10).

In preparing the transmission of the image data of those pages, it is checked as to whether or not the image data is image data of the even "n" page for the reverse (S11). When the image data is for the reverse (Yes in S11), the sequence of feeding the medium from the cassette 122 and containing it in the double-sided unit 141 is set in the printer CPU 251 (S12). In contrast, when the result of the check in step S11 reveals that the image data is image data of an odd (n−1) page for the obverse (No in S11), the sequence of feeding and discharging the medium having the image output already output on the reverse thereof and contained in the double-sided unit 141 onto the path 123 is set in the printer CPU 251 (S13).

When the image output for the obverse or reverse is output in step S12 or S13, the page number and the sequence pattern are updated (S14), and thus, the job relevant to the number of pages, started in step S2, comes to an end (S15).

In the meantime, when it is detected in step S7 that the page is a page of a final image output in the job (Yes in S7), it is determined as to whether or not the image output by the one-sheet circulation can be output from the already input image data (S21).

It is checked in step S21 as to whether or not the image data of pages whose image outputs can be output by the one-sheet circulation are stored in the image memory 212 (Yes in S21), and further, it is checked as to whether or not the image data of the corresponding pages have been already generated (S22). In the case where the image data of at least one page has been already generated (Yes in S22), the image data of that page is prepared to be transmitted (S10).

Hereinafter, in the same manner as described already, it is checked as to whether or not the image data is image data of the even "n" page for the reverse when the image data of that page is prepared to be transmitted (S11). When the image data is image data for the reverse (Yes in S11), the sequence of feeding the medium from the cassette 122 and containing it in the double-sided unit 141 is set in the printer CPU 251 (S12). In contrast, when the result of the check in step S11 reveals that the image data is image data of the odd (n−1) page for the obverse (No in S11), the sequence of feeding and discharging the medium having the image output already output on the reverse thereof and contained in the double-sided unit 141 onto the path 123 is set in the printer CPU 251 (S13).

When the image output for the obverse or reverse is output in step S12 or S13, the page number and the sequence pattern are updated (S14), and thus, the job relevant to the number pages, started in step S2, comes to an end (S15).

In the meantime, it is checked in step S9 as to whether or not the image data of pages whose image output can be output by the alternate circulation are stored in the image memory 212 (that is, whether or not the image data of two pages have been already generated). When the image data of two pages is not stored in the image memory 212 (No in S9), it is checked as to whether or not "the print continuing request" is sent from the printer CPU 251 (S31). When "the print continuing request" is not sent (No in S31), the job comes to an end (S15).

In contrast, it is checked in step S9 as to whether or not the image data of pages whose image output can be output by the alternate circulation is stored in the image memory 212 (that is, whether or not the image data of two pages has already been generated). As a result, when the image data of two pages is not stored in the image memory 212 (No in S9), it is checked as to whether or not "the print continuing request" is sent from the printer CPU 251 (S31). When "the print continuing request" is sent (Yes in S31), steps S21, S22 and S10 to S14, described already, are repeated.

Also in the case where the condition capable of achieving the alternate circulation is not satisfied in step S8 (No in S8), steps S21, S22 and S10 to S14 described above are repeated.

Incidentally, if the condition necessary for achieving one-sheet circulation is not satisfied in step S21 (No in S21), or the image data whose image output can be output in the one-sheet circulation in step S22 is not stored in the image memory 212 (No in S22), the job comes to an end (S15).

Figure 5A:
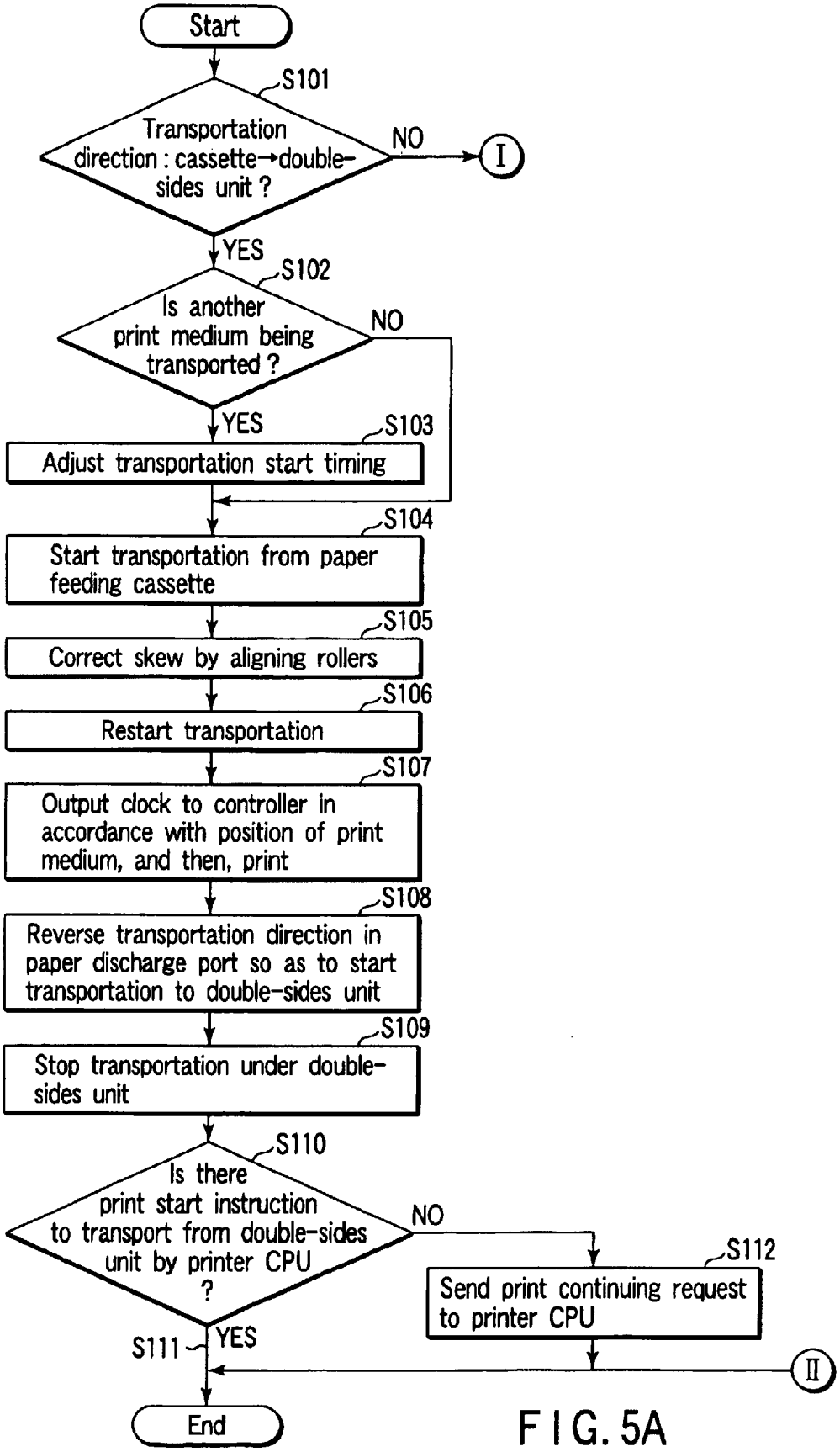
FIGS. 5A and 5B are flowcharts illustrating one example of operation of the printer controller, a printer CPU and a process unit illustrated in reference to FIG. 2.
Figure 5B:
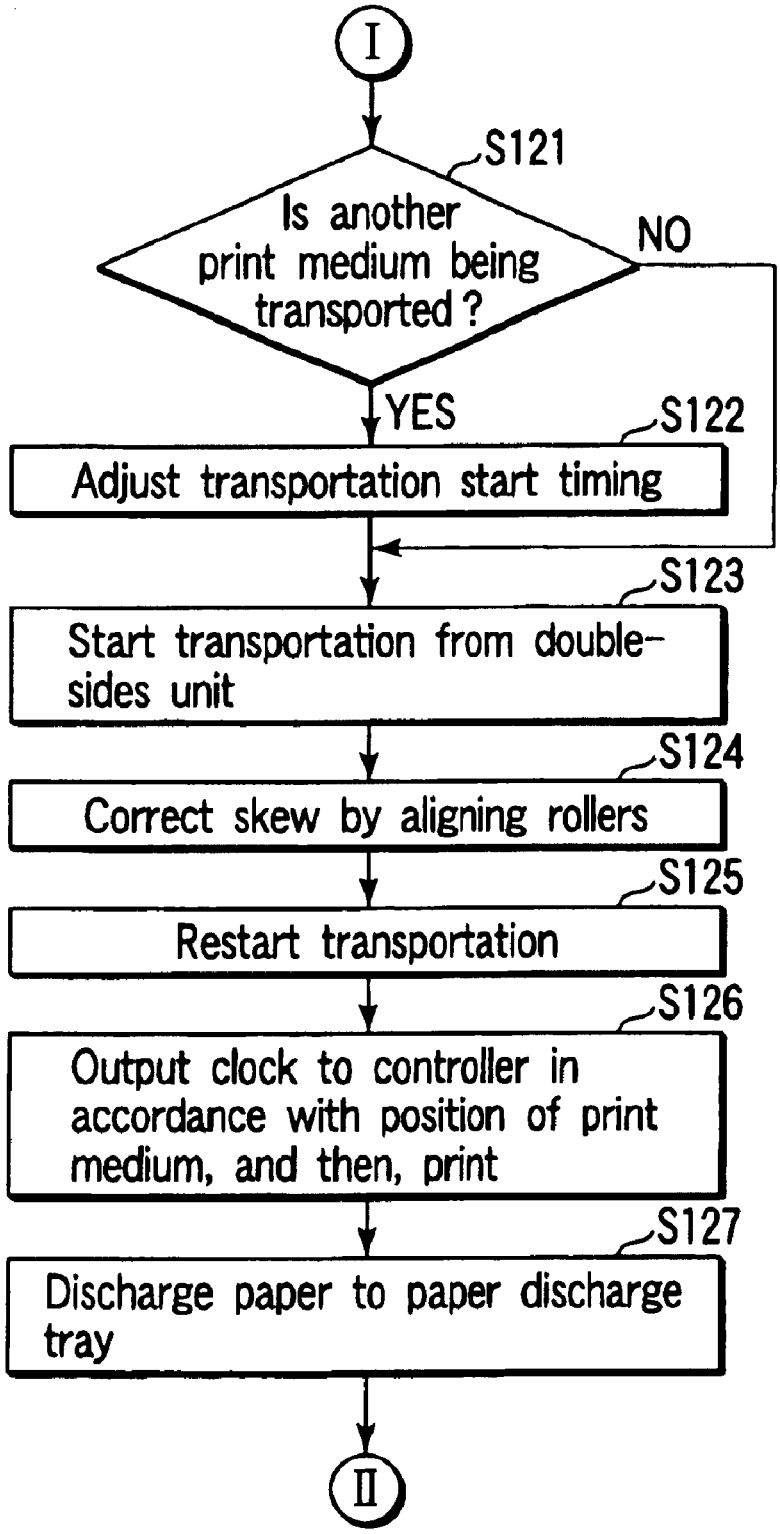

FIGS. 5A and 5B are flowcharts illustrating one example of the operation of the process unit 111 and the printer CPU 251.

When the image output (print) of one page is input into the printer CPU 251, first, the medium supply path is checked (S101).

When it is checked in step S101 that the medium supply path runs from the cassette 122 to the double-sided unit 141 (Yes in S101), subsequently, it is checked as to whether or not another medium is transported (S102).

When it is checked in step S102 that another medium is transported (Yes in S102), a transportation start timing is adjusted (S103).

Next, one sheet of the medium is drawn from the cassette 122 (S104), the skew of the medium can be corrected by the aligning rollers 124. Here, the medium transported to the aligning rollers 124 is stopped by the aligning rollers 124 until the aligning rollers 124 are rotated again at a predetermined timing (S105).

Subsequently, the aligning rollers 124 are rotated again, so that the medium is transported (S106).

Thereafter, a clock is output to the printer controller 201 in accordance with the position of the medium. The photosensitive drum 112 is irradiated with an exposure light beam whose light intensity is changed according to the image data, thereby forming the electrostatic image. The latent image formed on the photosensitive drum 112 is supplied with the developer (i.e., the toner) at a position facing the developing device 114, to be thus made visible. The resultant visible image is transferred as the toner image to the medium transported at a predetermined timing at the transferring position at which the transferring device 115 and the photosensitive drum 112 face each other (S107).

The transportation direction of the medium having the toner image transferred thereto is reversed after the toner image is fixed by the fixing unit 131, and then, the medium is guided to the double-sided unit 141. At this time, the medium is transported inside of the double-sided unit 141, so that the side having the toner image fixed thereto is reversed when the medium is guided again on the path 123 (S108).

The front end of the medium being transported inside the double-sided unit 141 is detected by the sensors 143 and 144, and then, the medium is transported to a given position inside the double-sided unit 141 in which the medium is managed for a predetermined period of time after the rear end thereof is detected by the sensor 143, and thus, the medium is once stopped (S109).

Next, the printer CPU 251 checks as to whether or not there is an instruction that the medium contained in the double-sided unit 141 is fed onto the path 123, and then, the image output is output (S110).

In the case where the instruction is issued in step S110 such that the medium contained in the double-sided unit 141 is fed onto the path 123, and then, the image output is output, the output of the image output with respect to the arbitrary one sheet of the medium is completed (S111).

In contrast, in the case where the instruction is not issued in step S110 such that the medium contained in the double-sided unit 141 is fed onto the path 123, and then, the image output is output, the printer controller 201 instructs the printer CPU 251 to send "the print continuing request" (S112).

Incidentally, when it is detected that another medium is not transported in step S102 (No in S102), one sheet of the medium is drawn from the cassette 122 in accordance with step S104.

When it is checked in step S101 that the medium supply path runs not from the cassette 122 to the double-sided unit 141, but from the double-sided unit 141 to the path 123 (No in S101), subsequently, it is checked as to whether or not another medium is transported (S121).

When it is checked in step S121 that another medium is transported (Yes in S121), the transportation start timing is adjusted (S122).

Next, the medium staying at a given position of the double-sided unit 141 is fed on the path 123 (S123), and then, the skew of the medium can be corrected by the aligning rollers 124. Here, the medium transported to the aligning rollers 124 is stopped by the aligning rollers 124 until the aligning rollers 124 are rotated again at the predetermined timing (S124).

Subsequently, the aligning rollers 124 are rotated again, so that the medium is transported (S125). Thereafter, the clock is output to the printer controller 201 in accordance with the position of the medium. The photosensitive drum 112 is irradiated with an exposure light beam whose light intensity is changed according to the image data, thereby forming the electrostatic image. The latent image formed on the photosensitive drum 112 is supplied with the developer (i.e., the toner) at the position facing to the developing device 114, to be thus made visible. The resultant visible image is transferred as the toner image to the medium being transported at the predetermined timing at the transferring position at which the transferring device 115 and the photosensitive drum 112 face each other (S126).

The toner image is fixed to the medium having the toner image transferred thereto by the fixing unit 131, and then, the medium is discharged to the discharge tray 11 as it is (S127).

Figure 7A:
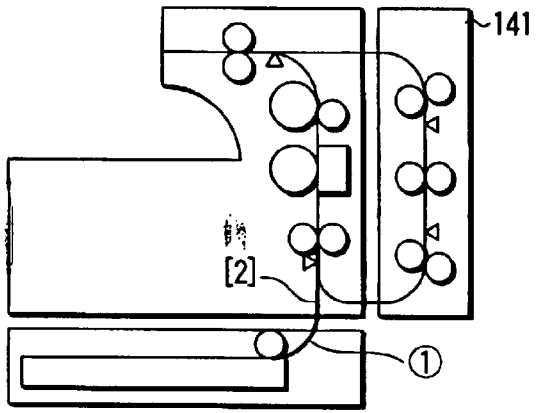
FIGS. 7A to 7L are schematic diagrams illustrating one example of a medium transporting control by the image forming apparatus for obtaining image outputs of ten pages on five sheets.
Figure 7B:
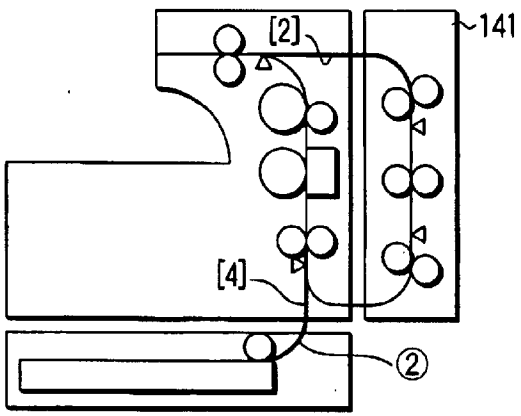
Figure 7C:
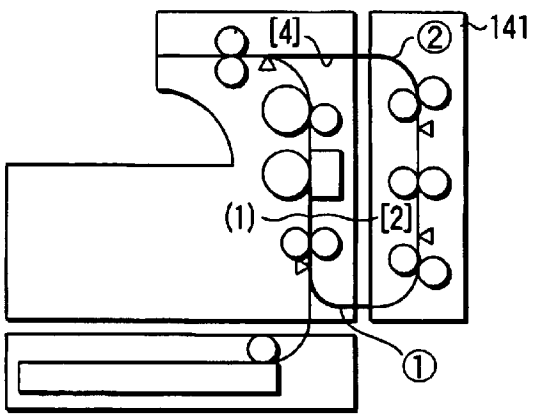
Figure 7D:
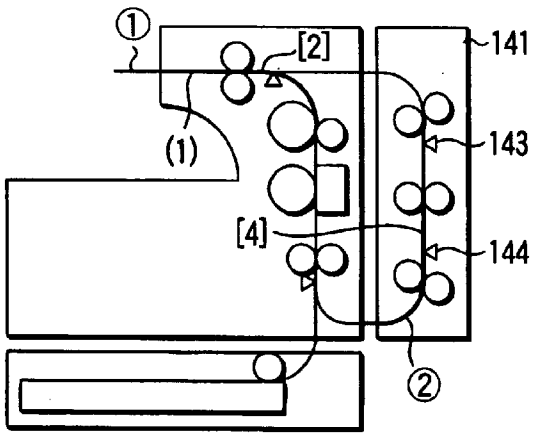
Figure 7E:
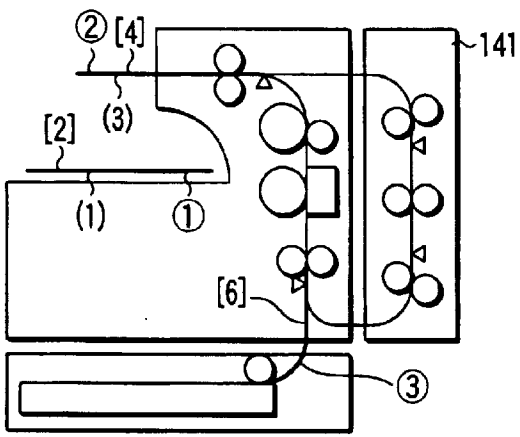
Figure 7F:
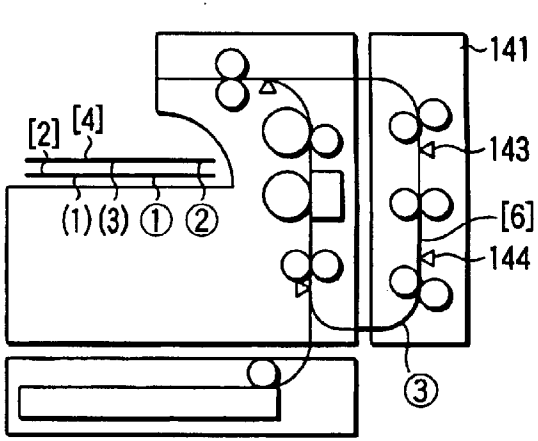

In view of this, in the embodiment according to the present invention, the timing at which the above-described print continuing request is sent is set to a timing at which the medium is transported to the predetermined position under the path 142 defined inside the double-sided unit 141, for example, a timing at which the printer controller 201 instructs no image formation on the obverse in a state in which the medium completely passes through the sensor 143 while a state in which the medium is detected by the sensor 144 is maintained, as described later in reference to FIGS. 7D and 7F.

When the printer CPU 251 determines the instruction of the switch from the alternate circulation to the one-sheet circulation, it sends the print continue request to the printer controller 201.

At the time the print continuing request is received by the printer controller 201, the image data for the obverse should have been already generated in the alternate circulation, as illustrated in FIG. 3A. Therefore, the printer controller 201 interrupts the alternate circulation upon the receipt of the print continuing request, and then, feeds the medium contained in the double-sided unit 141 to the path 123. Thus, the printer controller 201 instructs the printer CPU 251 to output the image for the corresponding obverse in the one-sheet circulation.

In contrast, if the image data for the obverse, in which the image output can be achieved in the alternate circulation, is compiled before the print continuing request is sent, the printer controller 201 switches from the one-sheet circulation to the alternate circulation, thereby outputting the image output.

Figure 6:
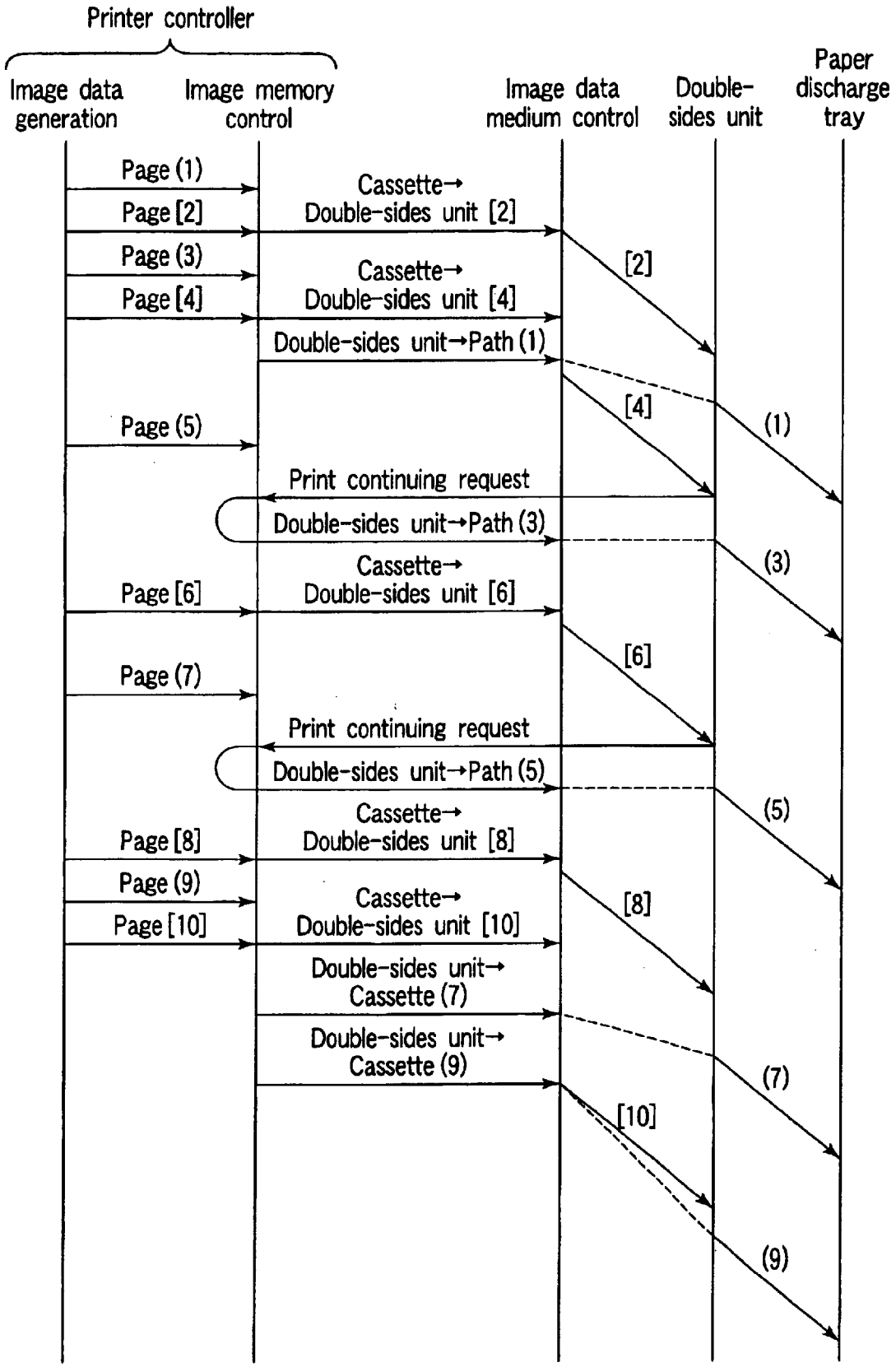
FIG. 6 is a schematic diagram illustrating one example of an image output sequence corresponding to the operation of the image forming apparatus illustrated in FIGS. 3, 4A, 4B, 5A and 5B.

In more detail, as illustrated in FIG. 6, in the case where, for example, the image data of ten pages is output onto the five media while switching the alternate circulation and the one-sheet circulation, it is preferable that the images are output in the order of the second page, the fourth page, the first page, the sixth page, the third page, the eighth page, the fifth page, the tenth page, the seventh page and the ninth page in the alternate circulation, in order to increase the entire throughput.

However, assume that, for example, the image data of the images to be output are complicated and much time is taken for generating the image data, and therefore, the generation of the image data of the sixth page (the storage of the image data in the image memory 212) is delayed from the image output by the process unit 111. In this case, it is preferable that the image output is output in the one-sheet circulation in such a manner as to prevent the medium contained in the double-sided unit 141 from being undesirably curled.

At this time, the printer CPU 251 sends the print continuing request to the printer controller 201. In response to this request, the medium contained in the double-sided unit 141 is fed to the path 123 by the printer controller 201. And then, the printer CPU 251 is instructed to change the output order of the image output in such a manner as to output the image corresponding to the third page to the medium having the output image of the fourth page already formed on the reverse thereof.

Hereinafter, at the time of completion of the image data for double sides, the image formation (i.e., printing out) is restarted from the image output for the reverse in accordance with the subsequent predetermined order.

Incidentally, in the case where the image data for next double sides are not stored in the image memory 212 (that is, the generation of the image data is delayed) at the time when the image output for the arbitrary reverse is output and fixed to a next medium, and then,-the medium is transported to the position of the sensor 144 inside the double-sided unit 141, the printer controller 201 controls to continue the one-sheet circulation.

In the meantime, in the case where the image data for next double sides are stored in the image memory 212 (that is, the generation of the image data follows) at the time when the image for the reverse is formed and fixed, and then, the medium is transported to the position of the sensor 144 inside the double-sided unit 141, another medium is fed from the paper cassette 122, and thereafter, the image output is output in the alternate circulation.

Incidentally, when no image data for the image output is supplied at the end of the job, that is, during a predetermined period of time, the printer controller 201 determines a final page, so that the image for the obverse is output onto the paper held inside of the double-sided unit 141 and having the image already output on the reverse thereof. In this case, the image is output in the final page order of the second page, the fourth page, the first page, the third page, the sixth page, the fifth page, the eighth page, the tenth page, the seventh page and the ninth page.

The above-described state of the sequential image formation will be explained in reference to FIGS. 7A to 7L. In FIGS. 7A to 7L, the page order in which the image outputs are output is designated by the sides on which leader lines marked to the media are led, wherein (n−1) added to each of the leader lines indicates the odd page (i.e., the obverse) while "n" indicates the even page (i.e., the reverse).

As described above, when the image outputs of the ten pages are output on double sides of the five media, first, the image output of the [2]nd page is output onto the reverse of the first medium, as illustrated in FIG. 7A, and then, the second medium is fed from the cassette 122 onto the path 123 while the first medium is transported to the double-sided unit 141 in such a manner that the obverse and reverse of the medium are reversed, as illustrated in FIG. 7B. Consequently, the image output of the [4]th page is output onto the reverse of the second medium.

Subsequently, the first medium contained in the double-sided unit 141 is transported onto the path 123 in such a manner as to output the image output of the (1)st page onto the obverse thereof, as illustrated in FIG. 7C, and thus, the image of the (1)st page is output onto the obverse of the first medium.

Thereafter, the first medium having the image output of the (1)st page output onto the obverse thereof, and the image output of the [2]nd page output onto the reverse thereof is discharged to the discharge tray 11, as illustrated in FIG. 7D.

Subsequently, the second medium contained in the double-sided unit 141 is transported on the path 123.in such a manner as to output the image output of the (3)rd page onto the obverse thereof, and thus, the image of the (3)rd page is formed on the obverse of the second medium. Thereafter, the second medium having the image output of the (3)rd page output onto the obverse thereof and the image output of the [4]th page output onto the reverse thereof is discharged to the discharge tray 11, as illustrated in FIG. 7E. At this time, the third medium is guided from the cassette 122 onto the path 123 at the predetermined timing such that the image output of the [6]th page can be output onto the reverse thereof.

Here, as described above, in the case where the image data to be supplied to the image memory 212 does not reach those of the two pages, that is, in the case where the image data for outputting the image output of the [8]th page is not stored in the image memory 212 at the above-described predetermined timing (in other words, during the predetermined period of time after the rear end of the third medium being transported inside the double-sided unit 141 passes the sensor 143), the alternate circulation is switched to the one-sheet circulation, as illustrated in FIG. 7F, so that the third medium currently contained in the double-sided unit 141 is fed onto the path 123.

Figure 7I:
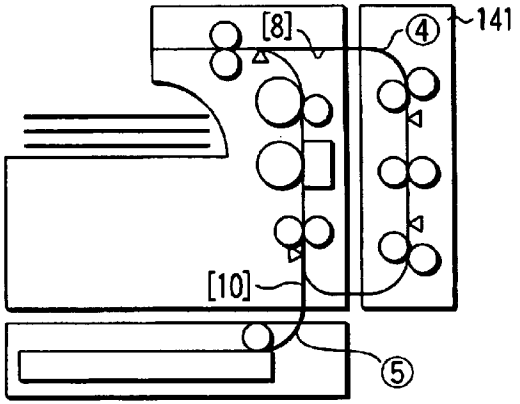
Figure 7H:
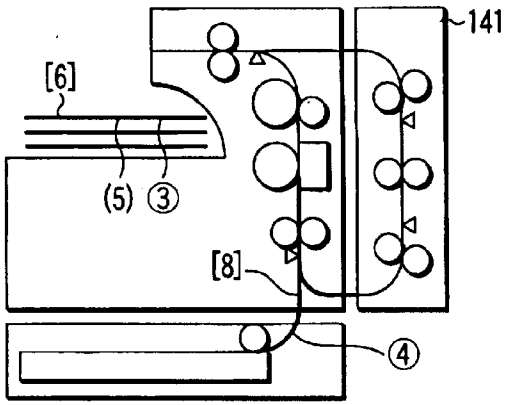
Figure 7G:
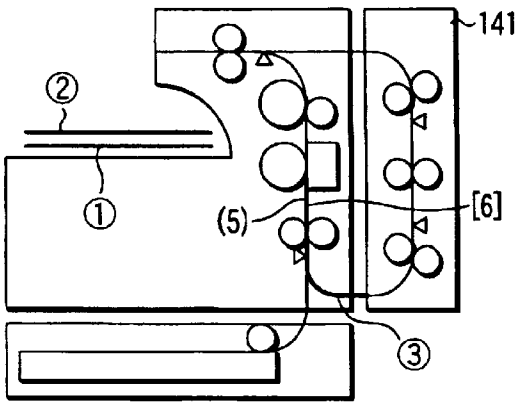

In this manner, as illustrated in FIG. 7G, the image output of the (5)th page is output onto the obverse of the third medium having the image output of the [6]th page already output on the reverse thereof, and then, the third medium having the image outputs of the (5)th and [6]th pages already output thereon is discharged to the discharge tray 11.

Hereinafter, the one-sheet circulation is continued until the image data to be stored in the image memory 212 reaches those of the two pages. Here, as illustrated in FIG. 7H, the image output of the [8]th page is output onto the reverse of the fourth medium, which is further fed in either case of the one-sheet circulation and the alternate circulation.

Next, as illustrated in FIG. 7I, if the image data of two pages is supplied to the image memory 212 until the rear end of the fourth medium passes the sensor 143 in the double-sided unit 141, the fifth medium is sequentially fed in the path 123, and then, the image output of the [10]th page is output onto the reverse of the fifth medium.

Figure 7L:
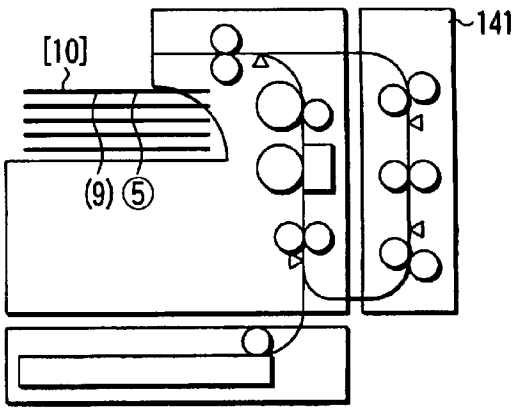
Figure 7K:
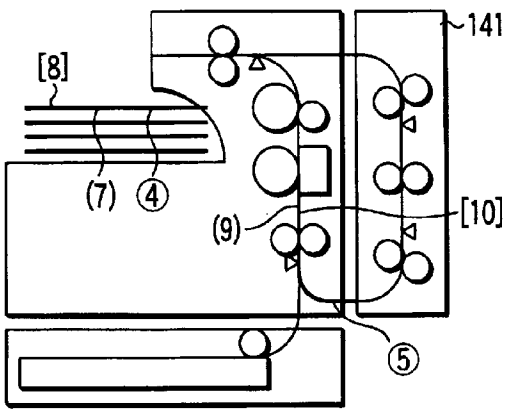
Figure 7J:
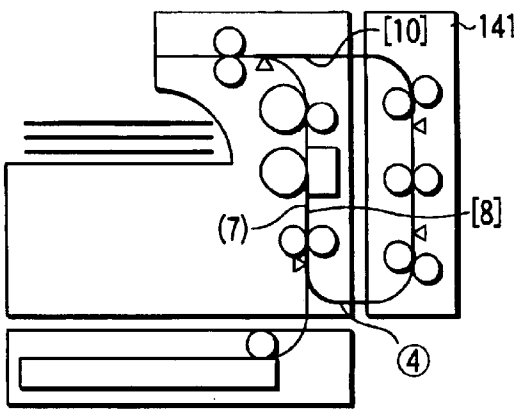

Hereinafter, as illustrated in FIG. 7J, in the case where there is no image data to be further input into the image memory 212 during the predetermined period of time, the image output of the (7)th page is output onto the obverse of the fourth medium contained in the double-sided unit 141, and then, the fourth medium having the image outputs of the (7)th and [8]th pages output thereonto is discharged to the discharge tray 11.

Subsequently, as illustrated in FIG. 7K, the image output of the (9)th page is output onto the obverse of the fifth medium having the image output of the [10]th page already output thereonto; and as illustrated in FIG. 7L, the fifth medium having the image outputs of the (9)th and [10]th pages output thereonto is discharged.

FIG. 6 is the schematic diagram illustrating the image output sequence, in which the image outputs of the ten pages can be output onto the five sheets, as illustrated in FIGS. 7A to 7L.

As illustrated in FIG. 6, the generation of the image data by the printer controller 201 and the storage of the image data in the image memory 212, and the movement of the medium via each of the process unit 111, the medium transporting system, i.e., the path 123, the aligning rollers 124, the fixing unit 131 and the double-sided unit 141 by the printer CPU 251 are on a sequential time axis. Here, the page numbers of the individual image outputs correspond to the odd page (n−1) and the even page "n" illustrated in FIGS. 7A to 7L on the time axis illustrated in FIG. 6. Furthermore, the image memory control and the image output control correspond to the obverse and reverse of the medium. The medium designated by "both-sides unit—path" signifies the image output onto the obverse; in contrast, the medium designated by "cassette—both-sides unit" signifies the image output onto the reverse.

As described above, in the embodiment according to the present invention, it is possible to increase the throughput in the case of the image outputs on the double sides of the medium without any occurrence of the curl in the medium while suppressing the cost.

Although the transportation and reversing of the medium, the generation of the image data and the storage in the image memory have been explained by way of the page printer in the above-described embodiment, it is understood that the present invention may be applied to a serial printer, a copying machine, a facsimile apparatus or a composite type copying machine in integral combination thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image memory which stores image data therein;

an image forming unit which outputs an image output on a predetermined side of a medium;

a reversing unit which reverses the obverse and reverse of the medium, on a first side of which the image output has been already output;

a medium transportation control unit which supplies the medium that has been transported to the reversing unit to the image forming unit again in order to output an image output on a second side, that is the reverse of the first side of the medium being transported to the reversing unit; and an image data control unit which, in the case where the image data of two pages are not stored in the image memory during the reversing of the medium, outputs image outputs in a first image forming mode of outputting an image output corresponding to image data of an even page on the first side of the medium, reversing the obverse and reverse, and outputting an image output corresponding to image data of an odd page on the reverse of the first side, and further outputs image outputs in a second image forming mode of, at the time when the image data stored in the image memory reach the amount of two pages, sequentially outputting an image output corresponding to image data of an n-th page that is an even page, n being a positive integer, and an image output corresponding to image data of a 2n-th page on first and second sides of each of sequential two media, respectively, reversing the obverses and reverses of the respective media, and thereafter outputting an image output corresponding to image data of an n−1-th page on the reverse of the first side of the medium, on which the image output corresponding to the image data of the n-th page is output, and subsequently outputting an image output corresponding to image data of a 2n−1-th page on the reverse of the first side of the medium, on which the image output corresponding to the image data of the 2n-th page is output.

2. An image forming apparatus according to claim 1, wherein the medium transportation control unit switches the transportation of the medium from the second image forming mode to the first image forming mode in the case where the image data of the two pages is not stored in the image memory at the time when the medium, on which the image output is output on the first side thereof is transported through the reversing unit and to a predetermined position inside of the reversing unit; and the image data control unit instructs the medium transportation control unit to switch from the second image forming mode to the first image forming mode at the time when it is detected that the image data of the two pages are not stored in the image memory, although the medium being transported through the reversing unit is transported to the predetermined position inside the reversing unit by the medium transportation control unit.

3. An image forming apparatus according to claim 2, wherein the image data control unit instructs the medium transportation control unit to switch from the second image forming mode to the first image forming mode in the case where it is detected that the image data of the two pages is not stored in the image memory at a predetermined timing after a sensor capable of previously detecting the front end of the medium detects that the rear end of the medium passes after the medium is detected by at least two medium detecting sensors included in the reversing unit.

4. An image forming apparatus according to claim 1, wherein the medium transportation control unit switches the transportation of the medium from the first image forming mode to the second image forming mode when it is detected that the image data of the second page is stored in the image memory at the time when the medium, on which the image output is output on the first side thereof is transported through the reversing unit and to a predetermined position inside the reversing unit during operation in the first image forming mode; and the image data control unit instructs the medium transportation control unit to switch from the first image forming mode to the second image forming mode at the time when it is detected that the image data of the two pages is stored in the image memory until the medium being transported through the reversing unit by the medium transportation control unit is transported to the predetermined position inside the reversing unit during the operation in the first image forming mode.

5. An image forming apparatus according to claim 4, wherein the image data control unit instructs the medium transportation unit to switch from the first image forming mode to the second image forming mode in the case where it is detected that the image data of the two pages is stored in the image memory at a predetermined timing after a sensor capable of previously detecting the fore end of the medium detects that the rear end of the medium passes after the medium is detected by at least two medium detecting sensors included in the reversing unit.

6. An image forming method comprising:

feeding first and second media in a predetermined order in such a manner as to output image outputs corresponding to 2n-th, 4n-th, up to mn-th pages on one side of each of the first and second media in the case where image data of two pages is held in an image data holding unit, n being a positive integer and m being a positive even integer with a value greater than 4;

reversing the obverses and reverses of the respective media by a reversing unit;

feeding the first medium in such a manner as to output an image output of a 2n−1-th page on the other side of the first medium, on which the image output of the 2n-th page is output, and feeding the second medium in such a manner as to output an image output of a 4n−1-th page on the other sideof the second medium, on which the image output of the 4n-th page is output;

transporting the medium, on which the image output corresponding to any page of the 2n-th, 4n-th, up to mn-th pages is currently output, to the reversing unit so as to reverse the obverse and reverse of the medium at the time when it is detected that image data of two pages is not held in an image data holding unit; and transporting the medium in such a manner as to output an image output of a page preceded by one page to the page of the image output that has been just output on the other side of the medium, wherein the transportation of the medium is switched from a second image forming mode to a first image forming mode in the case where image data of a second page is not stored in an image memory at the time when the medium, on which the image output is output on the first side thereof, is transported through the reversing unit and to a predetermined position inside the reversing unit; and the switch from the second image forming mode to the first image forming mode is instructed at the time when it is detected that the image data of the two pages is not stored in the image memory, although the medium being transported through the reversing unit is transported to the predetermined position inside the reversing unit.

7. An image forming method comprising:

feeding first and second media in a predetermined order in such a manner as to output image outputs corresponding to 2n-th, 4n-th, up to mn-th pages on one side of each of the first and second media in the case where image data of two pages is held in an image data holding unit, n being a positive integer and m being a positive even integer with a value greater than 4;

reversing the obverses and reverses of the respective media by a reversing unit;

feeding the first medium in such a manner as to output an image output of a 2n−1-th page on the other side of the first medium, on which the image output of the 2n-th page is output, and feeding the second medium in such a manner as to output an image output of a 4n−1-th page on the other side of the second medium, on which the image output of the 4n-th page is output;

transporting the medium, on which the image output corresponding to any page of the 2n-th, 4n-th, up to mn-th pages is currently output, to the reversing unit so as to reverse the obverse and reverse of the medium at the time when it is detected that image data of two pages is not held in an image data holding unit; and transporting the medium in such a manner as to output an image output of a page preceded by one page to the page of the image output that has been just output on the other side of the medium, wherein the transportation of the medium is switched from a first image forming mode to a second image forming mode when it is detected that image data of a second page is stored in an image memory at the time when the medium, on which the image output is output on the first side thereof, is transported through the reversing unit and to a predetermined position inside the reversing unit during operation in the first image forming mode; and the switch from the first image forming mode to the second image forming mode is instructed at the time when it is detected that the image data of the two pages is stored in the image memory until the medium being transported through the reversing unit is transported to the predetermined position inside the reversing unit during the operation in the first image forming mode.

8. An image forming apparatus comprising:

an image memory which stores image data therein;

an image forming unit which outputs an image output on a predetermined side of medium;

a reversing unit which reverses the obverse and reverse of the medium, on a first side of which the image output has been already output;

a medium transportation control unit which transports the medium in such a manner as to output the image output of n+2 page on one side of the medium on which image has been just output and to output the image output of n+1 page on the other side of the medium, at the time when it is detected that the image data of n+1 to n+4 pages are not held in an image data holding unit, n being a positive integer; and an image data control unit which outputs image data corresponding to n+1 page and n+4 page on either side of first and second media in a case where the image data of n+1 to n+4 pages is held in the image data holding unit, wherein the medium transportation control unit switches the transportation of the medium from the second image forming mode to the first image forming mode in the case where the image data of the two pages is not stored in the image memory at the time when the medium, on which the image output is output on the first side thereof is transported through the reversing unit and to a predetermined position inside of the reversing unit; and the image data control unit instructs the medium transportation control unit to switch from the second image forming mode to the first image forming mode at the time when it is detected that the image data of the two pages are not stored in the image memory, although the medium being transported through the reversing unit is transported to the predetermined position inside the reversing unit by the medium transportation control unit.

9. An image forming apparatus comprising:

an image memory which stores image data therein;

an image forming unit which outputs an image output on a predetermined side of medium;

a reversing unit which reverses the obverse and reverse of the medium, on a first side of which the image output has been already output;

a medium transportation control unit which transports the medium in such a manner as to output the image output of n+2 page on one side of the medium on which image has been just output and to output the image output of n+1 page on the other side of the medium, at the time when it is detected that the image data of n+1 to n+4 pages are not held in an image data holding unit, n being a positive integer; and an image data control unit which outputs image data corresponding to n+1 page and n+4 page on either side of first and second media in a case where the image data of n+1 to n+4 pages is held in the image data holding unit, wherein the medium transportation control unit switches the transportation of the medium from the first image forming mode to the second image forming mode when it is detected that the image data of the second page is stored in the image memory at the time when the medium, on which the image output is output on the first side thereof is transported through the reversing unit and to a predetermined position inside the reversing unit during operation in the first image forming mode; and the image data control unit instructs the medium transportation control unit to switch from the first image forming mode to the second image forming mode at the time when it is detected that the image data of the two pages is stored in the image memory until the medium being transported through the reversing unit by the medium transportation control unit is transported to the predetermined position inside the reversing unit during the operation in the first image forming mode.

10. An image forming method for outputting image data corresponding to n+1 page and n+4 page on either side of first and second media in a case where the image data of n+1 to n+4 pages is held in the image data holding unit, n being a positive integer, said method comprising:

feeding the first and second media in a predetermined order;

reversing obverses and reverses of the respective media by a reversing unit;

feeding the first medium in such a manner as to output an image output of the n+1 page on the other side of the first medium, on which an image output of n+2 page is output;

feeding the second medium in such a manner as to output an image output of n+3 page on the other side of the second medium, on which an image output of n+4 page is output; and transporting the medium in such a manner as to output the image output of n+2 page on one side of the medium on which image has been just output and to output the image output of n+1 page on the other side of the medium, at the time when it is detected that the image data of n+1 to n+4 pages are not held in the image data holding unit, wherein the transportation of the medium is switched from a second image forming mode to a first image forming mode in the case where image data of a second page is not stored in an image memory at the time when the medium, on which the image output is output on the first side thereof, is transported through the reversing unit and to a predetermined position inside the reversing unit; and the switch from the second image forming mode to the first image forming mode is instructed at the time when it is detected that the image data of the two pages is not stored in the image memory, although the medium being transported through the reversing unit is transported to the predetermined position inside the reversing unit.

11. An image forming method for outputting image data corresponding to n+1 page and n+4 page on either side of first and second media in a case where the image data of n+1 to n+4 pages is held in the image data holding unit, n being a positive integer, said method comprising:

feeding the first and second media in a predetermined order;

reversing obverses and reverses of the respective media by a reversing unit;

feeding the first medium in such a manner as to output an image output of the n+1 page on the other side of the first medium, on which an image output of n+2 page is output;

feeding the second medium in such a manner as to output an image output of n+3 page on the other side of the second medium, on which an image output of n+4 page is output; and transporting the medium in such a manner as to output the image output of n+2 page on one side of the medium on which image has been just output and to output the image output of n+1 page on the other side of the medium, at the time when it is detected that the image data of n+1 to n+4 pages are not held in the image data holding unit, wherein the transportation of the medium is switched from a first image forming mode to a second image forming mode when it is detected that image data of a second page is stored in an image memory at the time when the medium, on which the image output is output on the first side thereof, is transported through the reversing unit and to a predetermined position inside the reversing unit during operation in the first image forming mode; and the switch from the first image forming mode to the second image forming mode is instructed at the time when it is detected that the image data of the two pages is stored in the image memory until the medium being transported through the reversing unit is transported to the predetermined position inside the reversing unit during the operation in the first image forming mode.

* * * * *